US006351979B1

(12) United States Patent
Inamura et al.

(10) Patent No.: US 6,351,979 B1
(45) Date of Patent: Mar. 5, 2002

(54) EXTRUSION DIE

(75) Inventors: Akira Inamura, Tokyo; Michiyasu Serizawa, Susono, both of (JP)

(73) Assignee: Mitsubishi Aluminum Co., Ltd., Tokyo (JP)

( * ) Notice: Subject to any disclaimer, the term of this patent is extended or adjusted under 35 U.S.C. 154(b) by 0 days.

(21) Appl. No.: 09/676,111

(22) Filed: Sep. 29, 2000

(30) Foreign Application Priority Data

Sep. 29, 1999 (JP) ..... 11-277613
Sep. 29, 1999 (JP) ..... 11-277614
May 25, 2000 (JP) ..... 2000-155342

(51) Int. Cl.[7] ..... B21C 25/04
(52) U.S. Cl. ..... 72/269; 72/467
(58) Field of Search ..... 72/264, 269, 467, 72/468

(56) References Cited

U.S. PATENT DOCUMENTS 5,263,352 A * 11/1993 Yano ..... 72/269
5,571,235 A * 11/1996 Yano ..... 72/269
5,572,894 A * 11/1996 Yano ..... 72/269
6,134,936 A * 10/2000 Cheung ..... 72/269

FOREIGN PATENT DOCUMENTS

JP 5-115918 * 5/1993 ..... 72/269
JP 6-142755 * 5/1994 ..... 72/269
JP 7-124634 5/1995
JP 9-155438 6/1997

* cited by examiner

*Primary Examiner*—Ed Tolan
(74) *Attorney, Agent, or Firm*—Scully, Scott, Murphy & Presser

(57) ABSTRACT

An extrusion die is provided to improve wear resistance and to suppress damage to the shaping section of the core die. The core die consists of a plurality of individually prepared protruding rod members 5 that includes a protrusion section 3*a* and a base section 3*b* that extends in the upstream direction with respect to the metal flow. The protruding rod members 5 are arranged in parallel in locating grooves 12 fabricated on the male die assembly 2. Each protruding rod member 5 has a base section 3*b* and a transverse locking notch 7 so that a stopper 8 locks all the protruding rod members 5 to prevent them from shifting in the axial direction of the protruding rod member.

10 Claims, 15 Drawing Sheets

FIG.17 PRIOR ART

EXTRUSION DIE

BACKGROUND OF THE INVENTION

1. Field of the Invention

The present invention relates to an extrusion die for making multi-hole flat tube suitable for making various types of aluminum heat exchangers, for example. This application is based on Japanese Patent Application Nos. Hei 11-277613, 11-227614, and 2000-155342, and the contents of which are incorporated herein by reference.

2. Description of the Related Art

Extrusion fabrication of various metals is a known technology for producing component parts for various electrical devices and automobiles. Extrusion fabrication is widely used in making aluminum tubing for various heat exchangers, such as evaporator, condenser, radiator and others for use in automobile air-conditioners because of the excellent hot working properties of aluminum. An extrusion die is used in practice to perform extrusion fabrication.

FIGS. 17~21 show some examples of known extrusion dies (refer to a Japanese Patent Application, First Publication No. Hei. 7-124634). A typical die shown is comprised by a male die 31 has an external appearance of a rectangular plate (refer to FIG. 17), and a female die 41 has an external appearance of a cylindrical column (refer to FIGS. 18, 19).

As shown in FIG. 17, the male die 31 having a specific plate thickness is made of a high-speed steel or a hot worked die steel, and in a central section of its end surface 32, a step section 33 is protruded from the surface. From the center of the step section 33 extends a protrusion section 34 containing a series of protrusions resembling comb teeth. Also, flow-in sections 36 sloping down toward the protrusion section 34 are formed on the wide surfaces 35 sandwiching the end surface 32. The both sides of the wide surfaces 35 having the flow-in sections 36 are referred to as coupling sections 37 of a uniform plate thickness.

On the other hand, as shown in FIGS. 18, 19, the female die 41 is comprised by a female die body 42 made of a die steel, and an insert member 43 made of the material harder than that of the female die body 42 such as a high-speed steel or a hard metal. The female die body 42 has an external appearance of cylindrical bar, and a radially extending channel section 45 of a given width is formed on an end surface 44 opposing the male die 31. A rectangular recess 47 is formed in the center of the bottom surface 46 of the channel section 45 for inserting the insert member 43.

The insert member 43 is formed in such a way that when it is coupled inside the recess 47, its upper surface is coplanar with the bottom surface 46 of the channel section 45, and in the center, a through-hole 48 that extends in an orthogonal direction to the channel 45 is formed, as shown in FIGS. 18, 19. The through-hole 48 is comprised by a die cavity 49 that has an elliptic shape and positioned at the top surface of the insert member 43 for inserting the protrusion section 34 to fabricate an aluminum material (billet) into a desired shape in the space formed between itself and the protrusion section 34, and an exit opening 50 that opens at the downstream surface of the insert member 43 and is shaped in such a way that the width of the exit opening is larger than the width of the die cavity 49. The insert piece 43 is shrink fitted to firmly engage with the recess 47.

Also, grooved channels 51 are formed on the two end surfaces 44 on both sides of the channel section 45 of the female die body 42, whose depth is shallower than that of the channel section 45, to extend in an orthogonal direction to the channel section 45. On the opposite end surface 52 of the female die body 42, a first hole section 53 whose entry end communicates with the through-hole 48 and whose exit end opens at the end surface 52 of the female die body 42 for discharging the extrusions, and a second hole section 54 cut out so as to cross the first hole section 53, and whose entry end opens at the bottom surface of the recess 47 and the exit end opens at the end surface 52.

The extrusion die is used by forming an integral die by locating the protrusion section 34 of the male die 31 within the die cavity 49 of the female die 41, and engaging the coupling section 37 of the male die 31 into the grooved channel 51 of the female die 41, and coupling the step section 33 of the male die 31 with the channel section 45 of the female die 41.

The extrusion die comprised by the male die 31 and the female die 41 is inserted into the through-hole of the die-holder that serves as a flow path of the metal, and is fixed therein, and the aluminum billet inserted into a billet hole of the container communicating with the through-hole of the die holder, is pressed towards the extrusion die by a stem of an extrusion press which is omitted in the Figure. The billet being extruded flows into a billet flow passage formed between the two wide surfaces 35 and the inner wall surface of the through-hole of the die-holder to the space formed between the protrusion section 34 of the male die 31 and the die cavity 49 of the female die 41, and in passing through the space formed between the die cavity 49 and the protrusion section 34, the multi-hole flat tube Ca such as the one shown in FIG. 20 is produced.

When the billet flows into the flow passage of the extrusion die, a high-temperature and high-pressure material impinges directly on the protrusion section 34 of the male die 31 to apply a high pressure so that the protrusion section 34 is rapidly worn out. For this reason, it is necessary to change the male die 31 most frequently, which results in a problem of high die cost. This problem is most severe when making the multi-hole flat tube Ca having many holes such as the one shown in FIG. 20, because of thinner size of the protrusion section 34 of the male die 31 resulting in low wear resistance.

To resolve such a problem, recent die development efforts resulted in an introduction of a two-piece construction of the core section that includes the protrusion section 34 at the tip of the male die 31 as indicated by 2-dot line in FIG. 17, for example. A core 31*a* is made separately of a wear resistant hard metal, and the other part of the male die body 31*b* is made of a regular die steel (refer, for example, to a Japanese Patent Application, First Publication, No. Hei 9-155438).

However, in the above process of making separate members, i.e., male die body 31*b* and a core 31*a* made of a hard metal or a high-speed steel, a difficulty is experienced in making the protrusion sections 34 at the tip of the core 31*a* shown in FIG. 21. This is because the hardness of the material itself is very high and high dimensional accuracy is required in making such fine parts, such parts can only be made currently by a normal discharge machining process using electrode plates or wire electrical discharge machining.

A disadvantage of such machining processes based on normal discharge machining based on electrode plates or wires is that because the core 31 a is made of a hard metal or high-speed alloys of very high hardness, although wear resistance is improved to a degree, the fabricated product is extremely vulnerable to chipping of the protrusion section 34.

The present inventors have undertaken detailed study of the protrusion section 34 of the core 31*a* made by the normal discharge machining or wire electrical discharge machining using scanning electron microscope. It was found that a molten abnormal layer that contains bumpy surface irregularities is formed on the surface of the protrusion section 34, and surface chipping and micro-flaking at the edge portion of the protrusion section 34 are experienced. It was thought that these are one of the reasons for making the protrusion section 34 susceptible to breakage.

That is, the nature of discharge machining is such that an electrode (plate, wire and the like) is positioned at a distance from an object to be fabricated so as to cause arc discharge between the electrode and the workpiece to produce melting and vaporizing of the material near the discharge point and blowing of the debris by explosive action of arc discharge. The present inventors reasoned that such violent high temperature melting by discharge machining would tend to produce defects such as the molten abnormal layer or corroded layer of low mechanical strength, as well as concentration of arc discharge on edges of the protrusion section 34 that are particularly susceptible. Such phenomena would cause a loss of strength of the protrusion section 34.

SUMMARY OF THE INVENTION

It is therefore an object of the present invention to provide an extrusion die having a superior wear resistance and durable protrusion sections.

The features of the present extrusion die to resolve the problems in the existing dies are provided in an extrusion die comprised by a male die having a plurality of protrusion sections separated at a given distance and a female die having a die cavity for inserting the protrusion sections, so that a die assembly prepared by linking coupling sections of the male die with coupling sections of the female die is installed in an extrusion press in such a way that a billet material is pushed through spaces formed between the die cavity and the protrusion sections to produce a multi-hole flat tube, wherein the male die is comprised by a male die body and a core member having the plurality of protrusion sections firmly locked in a central region of the male die body; wherein the core member is comprised by individually fabricated protruding rod members, comprising the protrusion sections and associated base sections, to be locked-in firmly with the male die body, that extend upstream with respect to a material flow.

In the present invention, the core is made up by a plurality of individually prepared protruding rod members so that the structure of the core is much simpler than the design of the conventional core so that they can be fabricated not using the discharge machining as much as possible but by using other fabrication methods such as grinding and polishing. Such simple mechanical processing methods do not produce the molten abnormal layer (bumpy surface) or chips and micro-flaking are less prone to be generated on the surface. For these reasons, durability of the core is increased significantly.

A second aspect of the present die is that the protrusion section formed at a downstream end on each of the protruding rod member serve as a shaping section to extrude the billet material into a given shape by contacting the billet material and the base section on an upstream end has a locking notch to prevent the protruding rod member to shift in an axial direction.

In the present invention, the locking section fabricated in the base section is engaged with the male die body when locking the protruding rod member to the male die body, thereby restricting any shift of the protruding rod members in the axial direction. Although the protruding rod members are under a great pressure when extruding the material caused by frictional forces generated by the flowing material, there is no danger of the protruding rod member shifting in the flow direction because the protruding rod members are locked-in by the male die body.

Another aspect of the invention is that the protruding rod member is fabricated by grinding at least those locations that contact the material.

In the present invention, the part that is most vulnerable to wear due to high load on the core is fabricated by grinding, and such grinding process can produce flat surfaces while suppressing surface roughness to produce smooth flat surfaces. Therefore, if it is desired to apply a film of coating on the areas that contact the material, it is possible to increase the bonding strength between the mother base of the core and the coating film, thereby increasing the durability of the core.

Still another aspect is that the protruding rod member is fabricated by polishing at least those locations that contact the material.

In the present invention, the part that is most vulnerable parts of the core to wear due to high load on the core are fabricated by polishing, and such grinding process can produce flat surfaces while suppressing surface roughness even more to produce smooth flat surfaces. Therefore, if it is desired to apply a film of coating on the areas that contact the material, it is possible to increase the bonding strength between the mother base of the core and the coating film even further, thereby increasing the durability of the core even further.

Still another aspect is that the protruding rod member is fabricated by first grinding at least those locations that contact the material, followed by polishing. Because the most vulnerable parts of the core to wear due to high load on the core are fabricated by grinding first followed by polishing, flat surfaces are produced quickly by grinding while increasing the precision of surface finish. Therefore, it is possible to satisfy both requirements of fabrication speed and fabrication precision.

Still another aspect is that the protruding rod member is fabricated by first electrical discharge machining or wire discharge machining and the like at least those locations that contact the material, followed by polishing. Because the most vulnerable parts of the core to wear due to high load on the core are fabricated by the electrical discharge machining first followed by polishing, fabrication speed is increased by the electrical discharge machining while increasing the precision of surface finish by polishing. Therefore, it is possible to satisfy both requirements of fabrication speed and fabrication precision.

Final aspect is that a protruding rod member fabricated by any of the methods proposed in the present invention has a finely serrated section fabricated along the axial direction at least around external tip regions of the protruding rod member.

Accordingly, because a serrated section is provided at least on the downstream tip section of the protrusion section, serrated lines are produced on the interior wall of the multi-hole flat tube produced from the present extrusion die, thereby increasing heat transfer area and generating turbulence in the stream flowing in the tubing so that the heat transfer efficiency of the heat exchanger is improved significantly.

As an overall summary of the present invention, it may be noted that the core is made of a number of individual protruding rod members, and the structure of the rod members is much simpler than that of the conventional core, method of fabrication is not limited the electrical discharge machining, and other methods such as grinding and/or polishing may be utilized. Simple mechanical fabrication such as grinding is able to finish the surface without creating many surface bumps compared with the electrical discharge machining process so that if it is desired to apply a wear resistant coating on the surfaces of the rod members to produce a durable core, with a titanium group of coatings for example, a strong bonding can be produced at the interface between the coating film and the base material. Also, simple mechanical fabrication methods do not produce the molten abnormal layer or chips, and micro-flaking are less prone to be generated on the surface, thereby enabling to increase the durability of the core significantly.

DESCRIPTION OF THE PREFERRED EMBODIMENTS

Preferred embodiments will be presented in the following with reference to the drawings.

Embodiment 1

Figure 1:
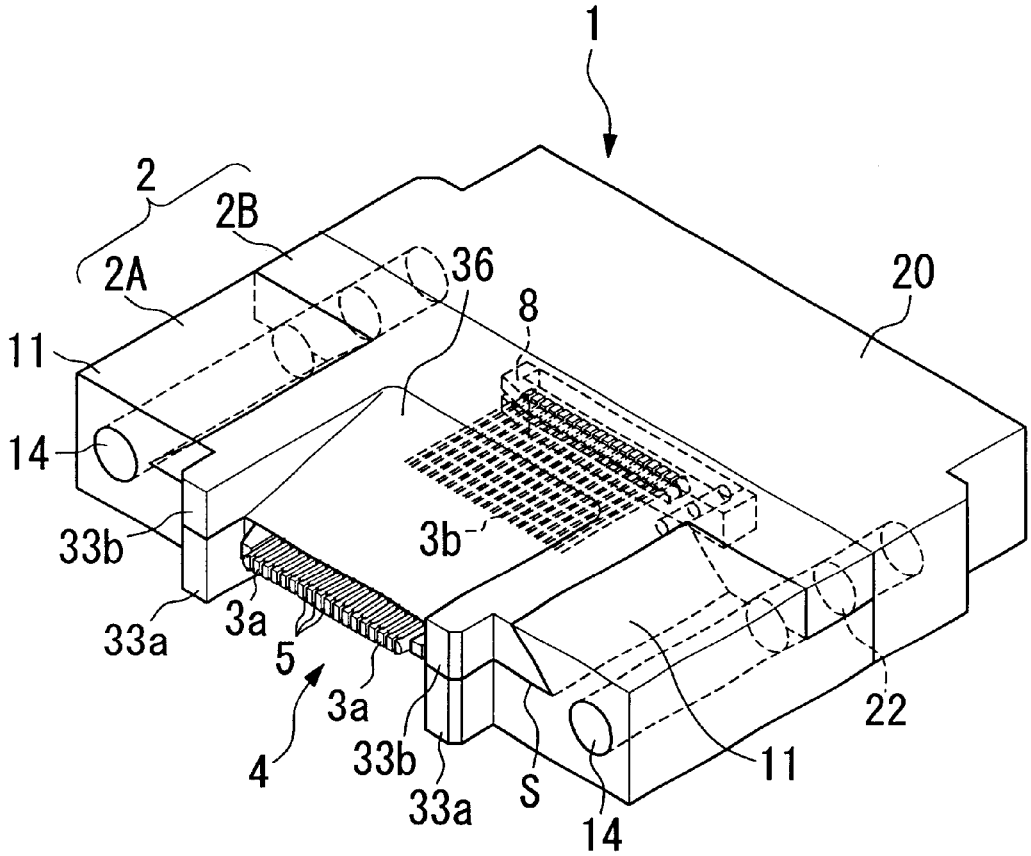
FIG. 1 is a perspective view of a male extrusion die in a first embodiment of the present invention.
Figure 2:
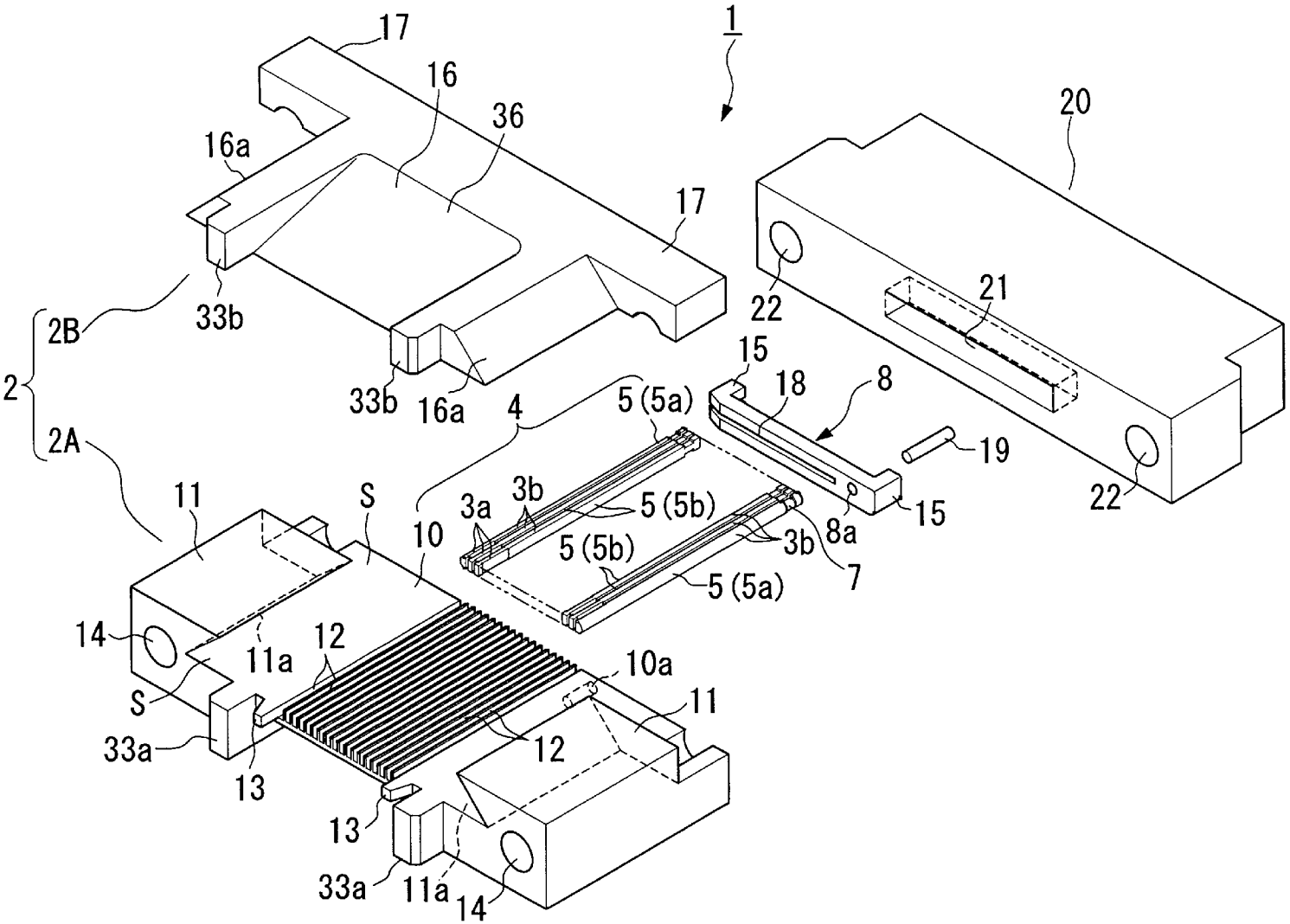
FIG. 2 is an exploded perspective view of the male die in the first embodiment.
Figure 17:
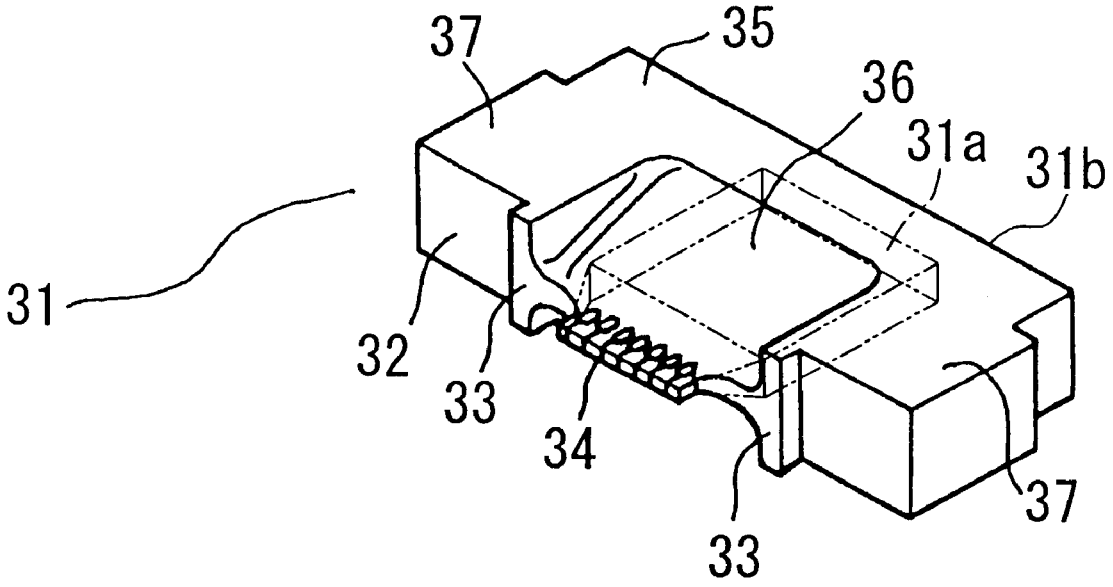
FIG. 17 is a perspective view of an example of the male component of a conventional extrusion die.

FIGS. 1~6 show various examples of the extrusion dies in the first embodiment. FIGS. 1 and 2 show the male die 1 of the extrusion die comprised by a male die 1 assembled within a female die 41. The structure of the female die 41 is the same as the conventional female die shown in FIGS. 18 and 19, so the explanation is omitted here. Also, the parts of the male die 1 that are the same as those in the conventional male die 31 shown in FIG. 17 are referenced by the same reference numerals and their explanations are omitted.

Figure 18:
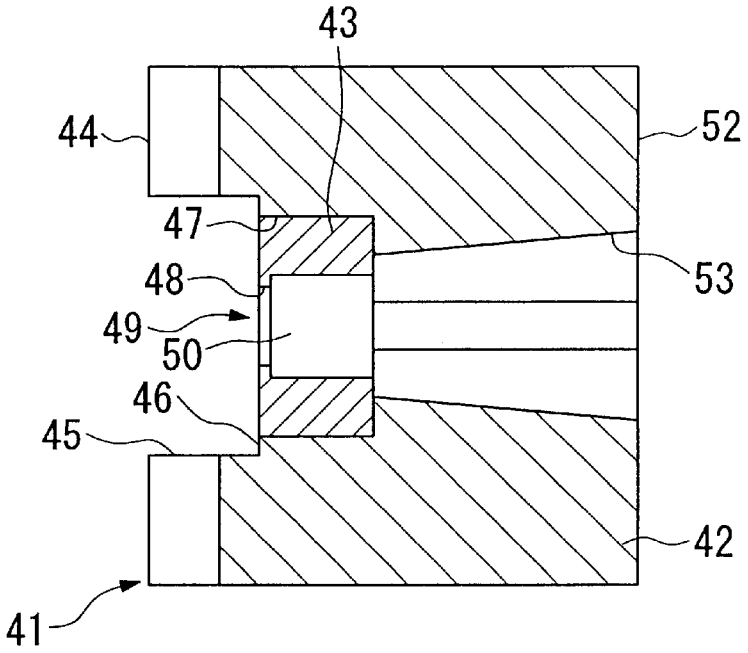
FIG.18 PRIOR ART
FIG. 18 is a cross sectional view of a conventional female die.
Figure 19:
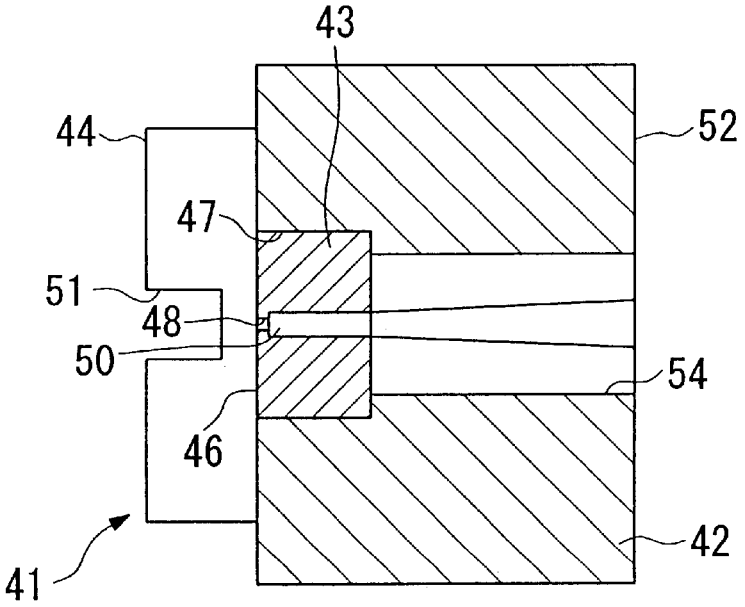
FIG.19 PRIOR ART
FIG. 19 is a cross sectional view through another plane of the female die shown in FIG. 18.

The male die 1 is used in a die assembly which is made by engaging respective coupling sections of the male die 1 and the female die 41 shown in FIGS. 18, 19, and is installed in an extrusion press.

That is, a protrusion section 3*a* of the male die 1 is positioned within the die cavity 49 of the female die 41 by engaging the coupling section 11, of the male die 1 in the die channel 51 of the female die 41, and the step section 33 of the male die 1 is coupled to the channel section 45 of the female die 41 to form an integral extrusion die assembly to be installed in the extrusion press (not shown) for extruding a billet.

The male die 1 is comprised by a male die assembly 2 and a core 4 having the protrusion section 3*a* to be firmly locked in the central region of the male die assembly 2.

The core 4 is comprised by protruding rod members 5 fabricated individually, each of which is comprised by the protrusion section 3*a* and a protrusion base 3*b* that extends upstream with respect to the billet flow, and firmly locked in the central region of the male die assembly 2. The protruding rod members 5 are firmly engaged on the mating surface S between the base section 2A and the lid section 2B of the male die assembly 2, whose center region at least is split in the thickness direction. More specifically, the protruding rod members 5 are firmly engaged within a plurality of parallel locating grooves 12 fabricated on the base section 2A of the split male body assembly, as shown in FIG. 2.

Figure 3:
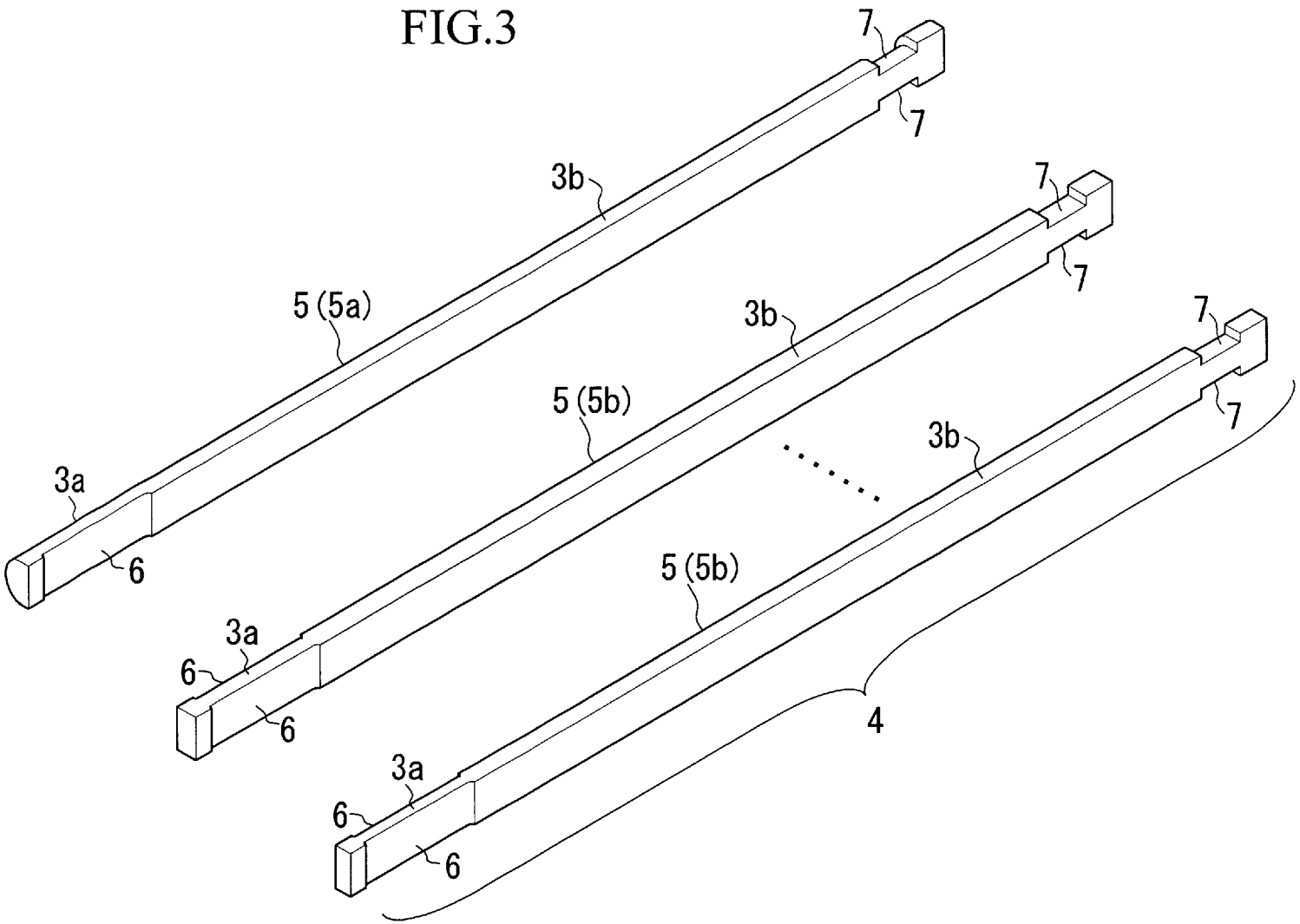
FIG. 3 is an exploded perspective view of the protruding rod member in the first embodiment.

As shown in FIG. 3, the protruding rod members 5 are prepared in two forms: end rods 5*a* that are placed at the left and right ends of the locating grooves 12, and center rods 5*b* that are placed therebetween. The cross sectional shape of the end rod 5*a* is semi-circular and a guide groove 6 is formed at the near the tip of the end rod 5*a* on the base of the arc. The guide groove 6 is used to guide the billet to flow smoothly in the extrusion direction.

On the other hand, the cross sectional shape of the center rods 5*b* is rectangular, in this case, and the guide groove 6 is provided on each left/right lateral surface for guiding the billet to flow smoothly. On the upper and lower surfaces of each of the end rods 5*a* and the center rods 5*b*, a locking notch 7 extending in the transverse direction (to the metal flow) is provided near the tip end of the base section of the protrusion base 3*b*. The transverse locking notches 7 are engaged with a stopper 8, which will be described later.

It should be mentioned that the guide groove 6 is not essential, and if the metal flow is smooth, it is not needed.

In the protruding rod members 5, the protrusion section 3*a* is provided on the tip end serves a shaping section so as to extrude the contacting billet into a desired shape. The transverse locking notch 7 is provided on the base end so as to enable to lock the protruding rod members 5 to the male die assembly 2 to prevent the protruding rod members 5 to shift in the axial direction under the pressure of extrusion.

Figure 4A:
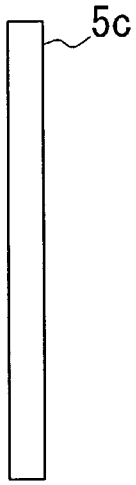
FIG. 4A is an illustration of an example of the protruding rod member.
Figure 4B:
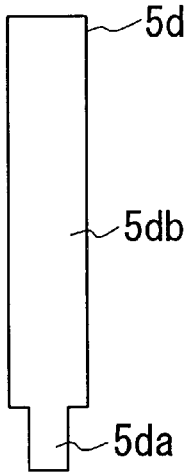
FIG. 4B is an illustration of an example of the protruding rod member.
Figure 4C:
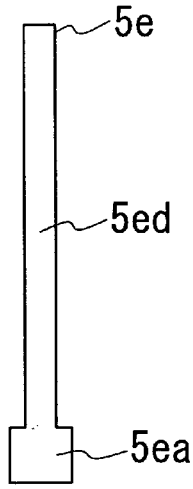
FIG. 4C is an illustration of an example of the protruding rod member.

In addition to those shapes shown in FIG. 3, various other shapes of the protruding rod members 5 are possible. For example, the entire shape may be made uniform from one end to the opposite end of the protruding rod member 5*c*, as shown in a plan view in FIG. 4A, or the tip end to contact the billet may be a narrow section 5*da* and the center and base sections are wide sections 5*da*, as shown in FIG. 4B, or conversely, the tip end to cut the billet may be a wide section 5*ea* and the center and base sections are narrow section 5*eb*, as shown in FIG. 4C. Or, the cross sectional view may be a square shape or a diamond shape.

Figures 6A, 6B, 6C, 6D, 6E:
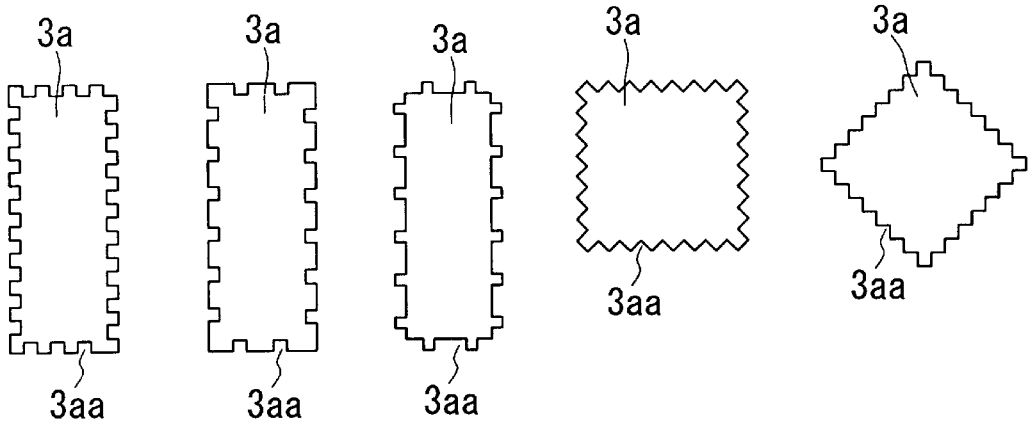
FIG. 6A is an illustration of an example of the profile shape of the tip of the protrusion section.
FIG. 6B is an illustration of an example of the profile shape of the tip of the protrusion section.
FIG. 6C is an illustration of an example of the profile shape of the tip of the protrusion section.
FIG. 6D is an illustration of an example of the profile shape of the tip of the protrusion section.
FIG. 6E is an illustration of an example of the profile shape of the tip of the protrusion section.

Also, the entire outer tip surface of the protruding rod members 5 may have a serration section 3*aa* provided with a series of notches of various shapes formed along the axial direction of the protrusion section 3*a*. Suggested shapes are triangular shaped notches and others as illustrated in FIGS. 6A~6E. The serration section 3*aa* shown in FIG. 6A has square shaped notches, rather triangular notches. The notches shown in FIG. 6B are square shaped notches comprised by wide tops and narrow valleys; while notches shown in FIG. 6B are square shaped wide tops and narrow valleys; and conversely, the notches shown in FIG. 6C are narrow tops and wide valleys; and the notches shown in FIG. 6D are formed on a square shaped protrusion section 3*a*. The notches shown in FIG. 6E are formed on a diamond shaped protrusion section 3*a*.

The protruding rod members 5 (5*a*, 5*b*, 5*c*, 5*d*, 5*e*) are made by grinding or polishing of hard metals or high-speed steels, and the male die assembly 2 shown in FIGS. 1, 2 is made of a material softer than the core 4, for example, high-speed steels or hot-worked die steels.

It is not necessary that fabrication of protruding rod members 5 be carried out by polishing throughout so that only those members that are exposed to higher stresses and subjected to rapid wear may need to be processed by mechanical fabrication methods, preferably grinding or polishing. The protruding rod members 5 of a semi-circular shape shown in FIG. 3 may be produced by first extruding a rod of a circular cross sectional shape and then splitting the rod in the axial direction by suitable means. Also, as necessary, at least the portion of the protruding rod members 5 that touches the billet may be milled first, and then finished by polishing. If wire electrical discharge is used to fabricate the protruding rod members, at least the portion that comes into contact with the billet should be additionally processed by grinding or polishing so as to eliminate the molten abnormal surface layer.

As shown in FIGS. 1, 2, the male die assembly 2 is a split-assembly, comprised by the base section 2A and a lid section 2B of the male die assembly 2.

The base section 2A is comprised basically of a plate section 10; thickwall sections 11, having a thickness slightly thicker that a half the thickness of the male die assembly 2, provided on left and right shoulders of the plate section 10. The parallel locating grooves 12 of a given spacing for engaging with the protruding rod members 5 are provided in the central region of the plate section 10. Also, in FIGS. 1, 2, bottom sections 33*a* of the step section 33 are provided on the left and right of the downstream end surface of the plate section 10 with respect to the billet flow direction, so as to locate at the outsides of the locating grooves 12. Furthermore, left/right triangular sections 13 are formed on the center region side of the bottom sections 33*a*, at about the same height as the protruding rod members 5 so as to extend downstream. The triangular sections 13 are provided to facilitate the billet to flow smoothly into the die cavity 49.

Figure 5A:
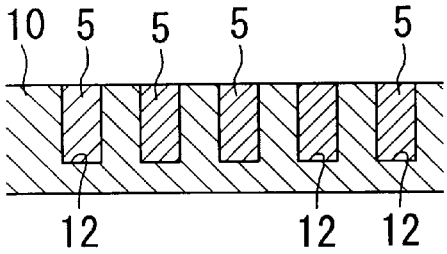
FIG. 5A is a cross sectional view of an example of the attaching the protruding rod members.

The locating grooves 12 comprised by a plurality of parallel grooves for engaging with the protruding rod members 5 provided in the center region of the plate section 10 of the male die 2 are not restricted to the type shown in FIG. 5A.

Figure 5B:
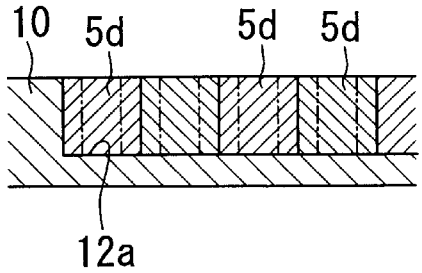
FIG. 5B is a cross sectional view of an example of the attaching the protruding rod members.

The locating grooves 12*a* may be made of a wide channel type so as to engage with a group of protruding rod members 5 which are tightly adjacent each other, as shown in FIG. 5B. In this case, the protruding rod members to fit into the wide locating grooves 12*a* should be the type shown in FIG. 4B that has a narrow section 5*da* at the tip section.

As shown in FIG. 2, on the base section 2A of the male die assembly 2, tapered surfaces 11*a*, wide at the bottom and narrow at the top, are formed on the shoulders of the center region of the left and right thickwall sections 11, to lock the tapered surfaces 16*a* formed on the lid section 2B of the male die assembly 2 in place so as to prevent the base section 2A of the male die assembly 2 to lift towards the thickness direction under the pressure of extrusion. On the shoulder sections of the base section 2A of the male die assembly 2 are formed a pair of left and right through-holes 14 for engaging with a cap member 20 to be described later. As shown in FIG. 2, the through-hole 14 on the base section 2A is split in half in the end region near the cap member 20.

In FIG. 2, the lid section 2B of the male die assembly 2 has a T-shape in the plan view, and is comprised by a rectangular section 16 for covering the top of the locating grooves 12 (of the base section 2B of the male die assembly 2) and shoulder sections 17 extending towards left and right at each end of the rectangular section 16. The tapered surfaces 16*a* are formed on the left and right ends of the rectangular section 16 to engage with the tapered surfaces 11*a* of the base section 2A of the male die assembly 2. And, on the downstream side of the rectangular section 16 with respect to the flow of the billet, top sections 33*b* to form the step section 33 are formed. Also, a flow-in section is formed on the upper surface of the rectangular section 16 that slopes down toward the downstream side with respect to the flow of the billet. To correspond with this shape, on the outer surfaces (cannot be seen in FIG. 2) of the outer side of the base section of the plate section of the male die assembly 2, a flow-in section is provided that similarly slopes down towards the downstream direction. The through-holes 14 provided on the bottom surfaces of the shoulder sections 17 are split so as to match the split holes formed on the base section 2A.

As shown in FIG. 2, the common stopper 8 is shaped as a U-piece in its plan view, and the left/right end sections are provided with bent sections 15, respectively, for the purpose of strengthening the end sections of the stopper 8. In the center region in the thickness direction of the stopper 8, a slit 18 is fabricated to lockup with the locking notch 7 that are formed on the top and bottom surfaces of the protruding rod members 5. The protruding rod members 5 and the common stopper 8 are firmly engaged with the male die assembly 2 by inserting the tips of the pins 19, through the hole 8*a* formed on the stopper 8, in the holes 10*a* formed on the base section 2A of the male die assembly 2.

As shown in FIGS. 1 and 2, a cap member 20 is provided for fitting into the male die 1 (at the upstream end with respect to the metal flow) to prevent the extrusion force to be applied through the billet to the upstream end of the male die 1 during the extrusion process. The thickness of the cap member 20 is selected to be about the same as that of the male die 1. Also, a hole 21 as shown in FIG. 2 is formed at the downstream end section of the cap member 20 for inserting the base region of the base section 3*b* of the protruding rod members 5 and the common stopper 8, and a space is provided between the center region of the upstream end of the male die 1 and the center region of the cap member 20. The size of the hole 21 is selected to be about the same as or slightly larger than the stopper 8 so as to enable to insert the stopper 8.

As shown in FIGS. 1, 2, the cap member 20 is located on the male die 1 by inserting locating pins (not shown) in the through-holes 14 of the male die assembly 2 and inserting the tips of the locating pins in the holes 22 formed in the cap member 20 to firmly fix its location. The pins pass through the through-holes 14 and fastened the cap member 20 by engaging with female screws which are formed the holes 22 of the cap member 20.

Next, the operation of the extrusion die constructed in the above manner will be described.

The male die 1 shown in FIG. 1 is coupled to the female die 41 shown in FIGS. 18, 19, to form a die assembly by engaging the respective coupling sections and the protrusion section 3*a* is positioned within the die cavity 49 of the female die 41, and the die assembly is mounted on an extrusion press (not shown). An aluminum billet is inserted into the container and is pushed towards the extrusion die by the stem of the extrusion press. The billet flows into the spaces between the protrusion section 3*a* of the core 4 and the die cavity 49 of the female die 41 shown in FIGS. 18, 19, and in flowing through the spaces between the die cavity 49 and the protrusion section 3*a*, the billet is formed into a desired shape of a multi-hole flat tube Ca, such as the one shown in FIG. 20. This mode of operation is the same as that in the conventional extrusion.

Figure 21:
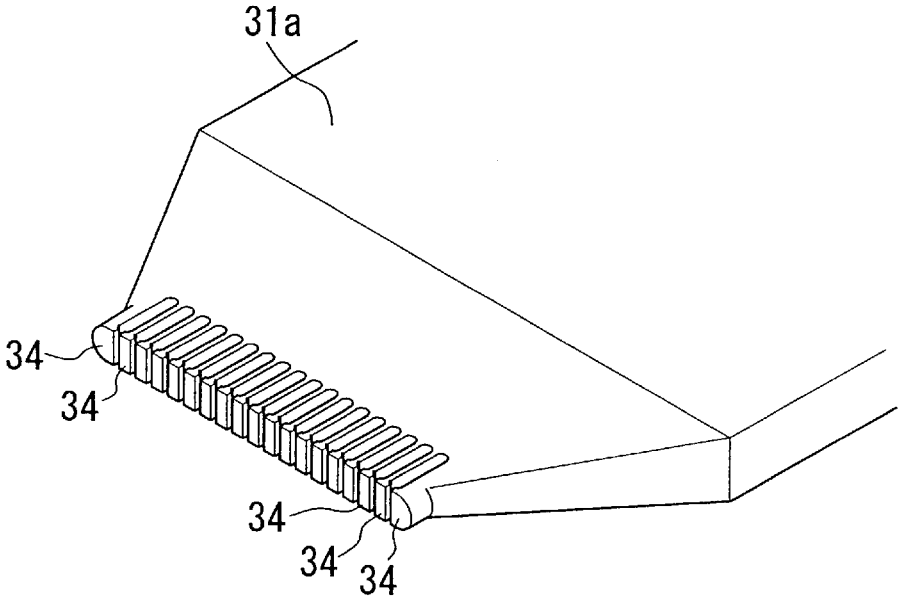
FIG.21 PRIOR ART
FIG. 21 is a perspective view of a core tip for explaining the problems in the conventional extrusion die.

The features of the present extrusion die will be explained in the following. First, the part of the male die 1 in FIG. 1, that is highly susceptible to wear, which is the core 4 including the protrusion section 3*a*, is made of a wear-resistant material such as hard metals or high-speed steels, and therefore, wear of the protrusion section 3a is effectively suppressed. Additionally, the present core 4, shown in FIGS. 1, 2, is comprised by a plurality of separate protruding rod members 5 (5*a*, 5*b*, 5*c*, 5*d*, 5*e*), and individual protruding rod members 5 (5*a*, 5*b*, 5*c*, 5*e*) are constructed simpler than the conventional core 31*a* shown in FIG. 21, so that is possible to fabricate them using grinding methods rather than the discharge machining. Mechanical fabrication methods such as grinding do not produce the molten abnormal layer that results from the discharge machining, or produce a phenomenon of chipping or micro-flaking so that the service life of the core 4, comprised of the protruding rod members 5, can be improved significantly.

Additionally, the serration sections 3*aa* (refer to FIG. 6) are formed on at least the outer peripheral tip region of the protrusion tip sections 3 of the protruding rod members 5, so that the serrated structure is duplicated along the axial lines on the inner surface of the multi-hole flat tube produced by such an extrusion die. Such a serrated structure increases heat transfer area and generates turbulent flow of the refrigerant flowing inside the tubing so that the heat transfer characteristics of the tubing are improved significantly.

Also, the male die assembly 2 shown in FIG. 2 is a split assembly, comprised by the base section 2A and the lid section 2B, that slices the center region in the thickness direction, and the protruding rod members 5 (5*a*, 5*b*, 5*c*, 5*d*, 5*e*) are locked in the mating surface S between the base section 2A and the lid section 2B, so that the protruding rod members 5 (5*a*, 5*b*, 5*c*, 5*d*, 5*e*) can be readily installed in the center region of the male die assembly 2, and furthermore, the protruding rod members 5 (5*a*, 5*b*, 5*c*, 5*d*, 5*e*) can be accessed by simply removing the lid section 2B from the base section 2A to facilitate maintenance operation.

Further, as shown in FIGS. 2, 3, each base section 3*b* of the protruding rod members 5 (5*a*, 5*b*, 5*c*, 5*d*, 5*e*) is provided with a transverse locking notch 7, and a common stopper 8 is engaged with the locking notch 7 of the protruding rod members 5 (5*a*, 5*b*, 5*c*, 5*d*, 5*e*), so that it is possible to prevent the protruding rod members 5 to be shifted by the flow of the metal during the extrusion process as well as to facilitate assembly of the protruding rod members 5.

Embodiment 2

FIGS. 7~12 show further examples of the male die configuration in Embodiment 2.

Figure 7:
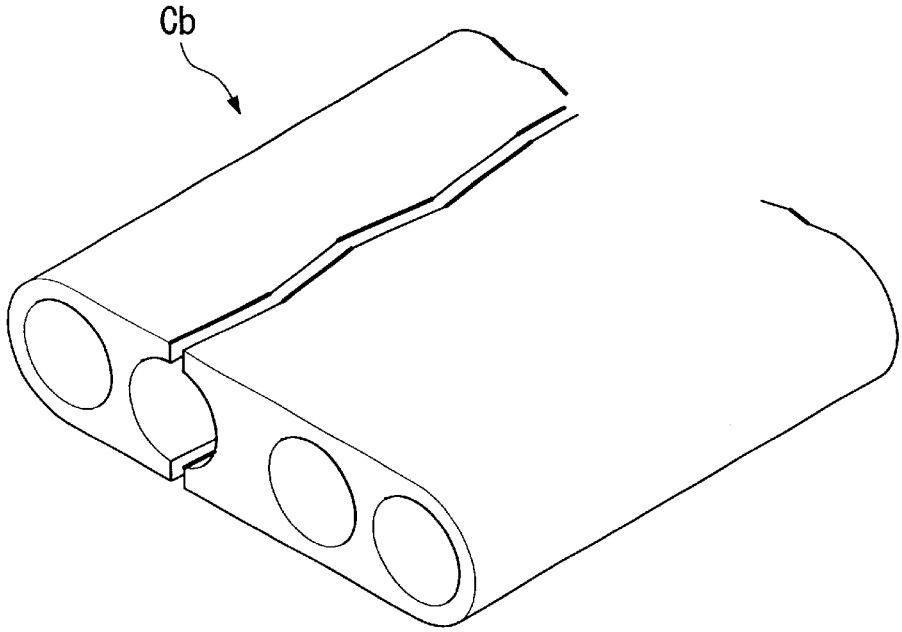
FIG. 7 is a perspective view of a multi-hole flat tube made by the extrusion die in a second embodiment of the present invention.
Figure 20:
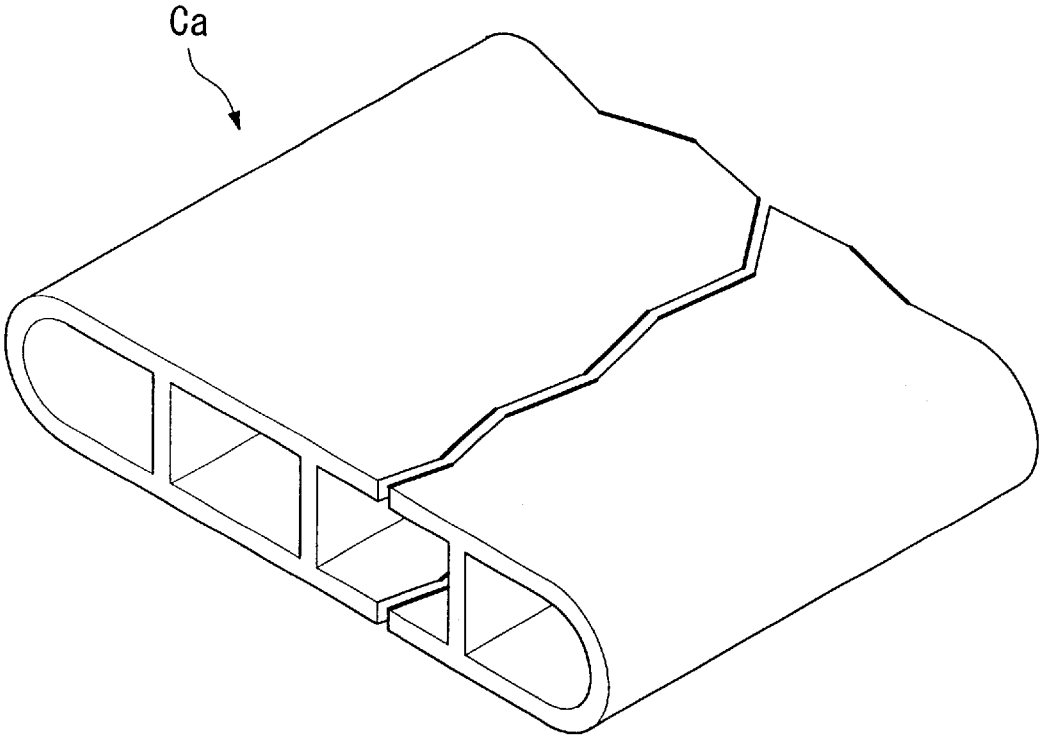
FIG.20 PRIOR ART
FIG. 20 is a perspective view of a multi-hole flat tube produced by the conventional extrusion die.

In Embodiment 1, the extrusion is a multi-hole flat tube Ca shown in FIG. 20, but in Embodiment 2, the extrusion is a multi-hole flat tube Cb, shown in FIG. 7, having holes of circular, oval or partially circular cross sectional shape. To produce the holes of circular or oval cross sectional shape, it is necessary to use protruding rod members having circular or oval cross sectional shape for the solid core.

Because such multi-hole flat tube Cb having holes of circular or oval cross sectional shape can withstand relatively high pressures of the refrigerant to flow in the tubing, flow speed of the refrigerant can be increased further, thereby further improving the heat transfer characteristics of the product.

The structures of most parts in Embodiment 2 are the same as those in Embodiment 1 and are referenced by the same reference numerals and explanations for the similar parts are omitted.

Figures 9A, 9B, 9C:
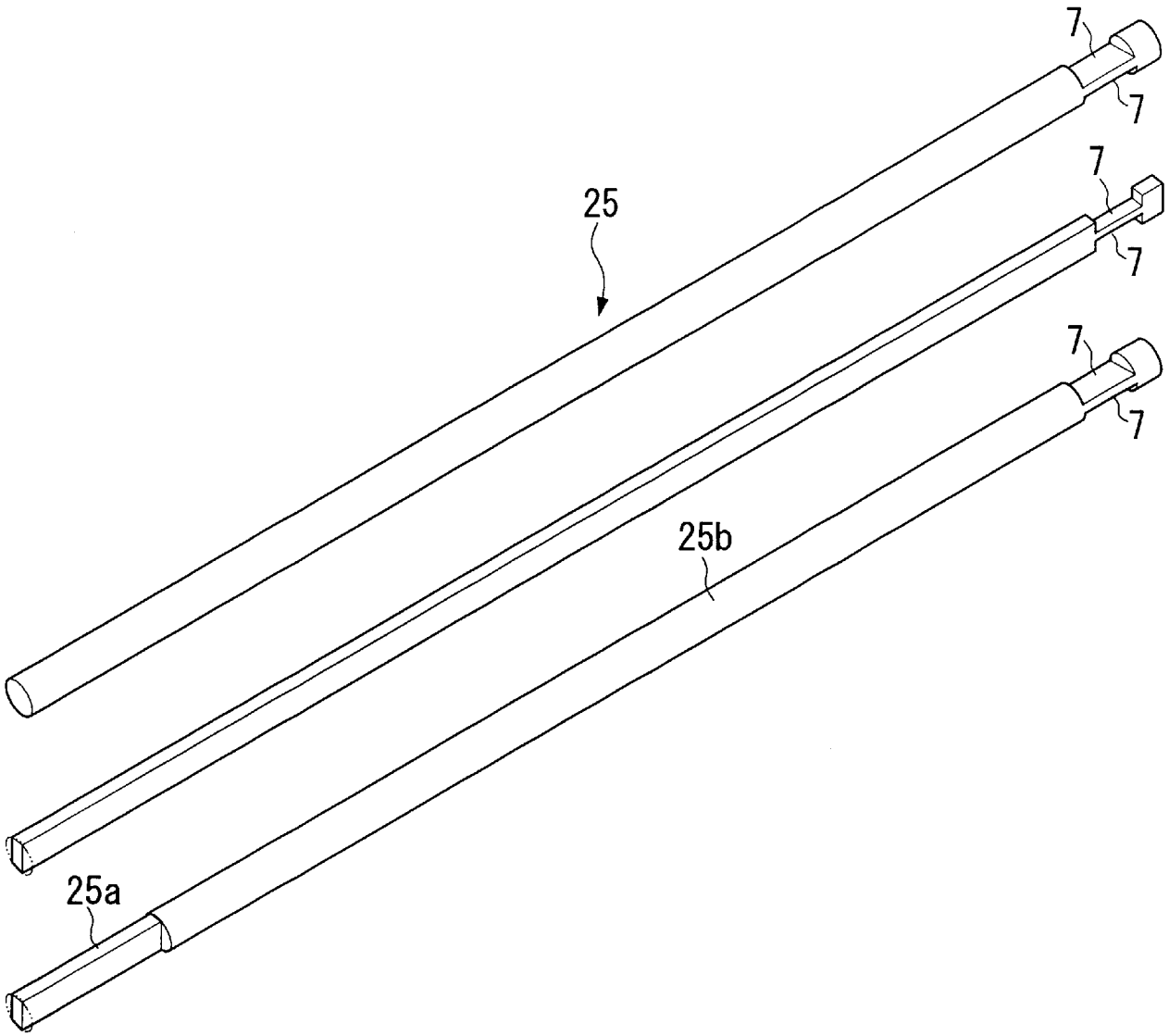
FIG. 9A is a perspective view of the protruding rod members in the second embodiment.
FIG. 9B is a perspective view of another example of the protruding rod member in the second embodiment.
FIG. 9C is a perspective view of another example of the protruding rod member in the second embodiment.

The protruding rod member 25 in Embodiment 2 is shaped circular throughout as shown in FIG. 9A, and the locking notches 7 are fabricated on the upper and lower surfaces near the base region of the base section in the transverse direction to the axial direction. The common stopper 8 is engaged with the locking notches 7. The protruding rod members 25 may include other shapes such as the one shown in FIG. 9B, whose left and right sides are flatted throughout, or the one shown in FIG. 9C, whose tip section 25*a* only is milled flat on the left and right surfaces, and the base section 25*b* is circular and larger than that of the tip section 25*a* in cross sectional area.

Further, the cross sectional shape of the protruding rod members 25 shown in FIG. 9A is not limited to a circular shape, and may include oval shapes or an oval shape having flat left and right surfaces.

Figure 10:
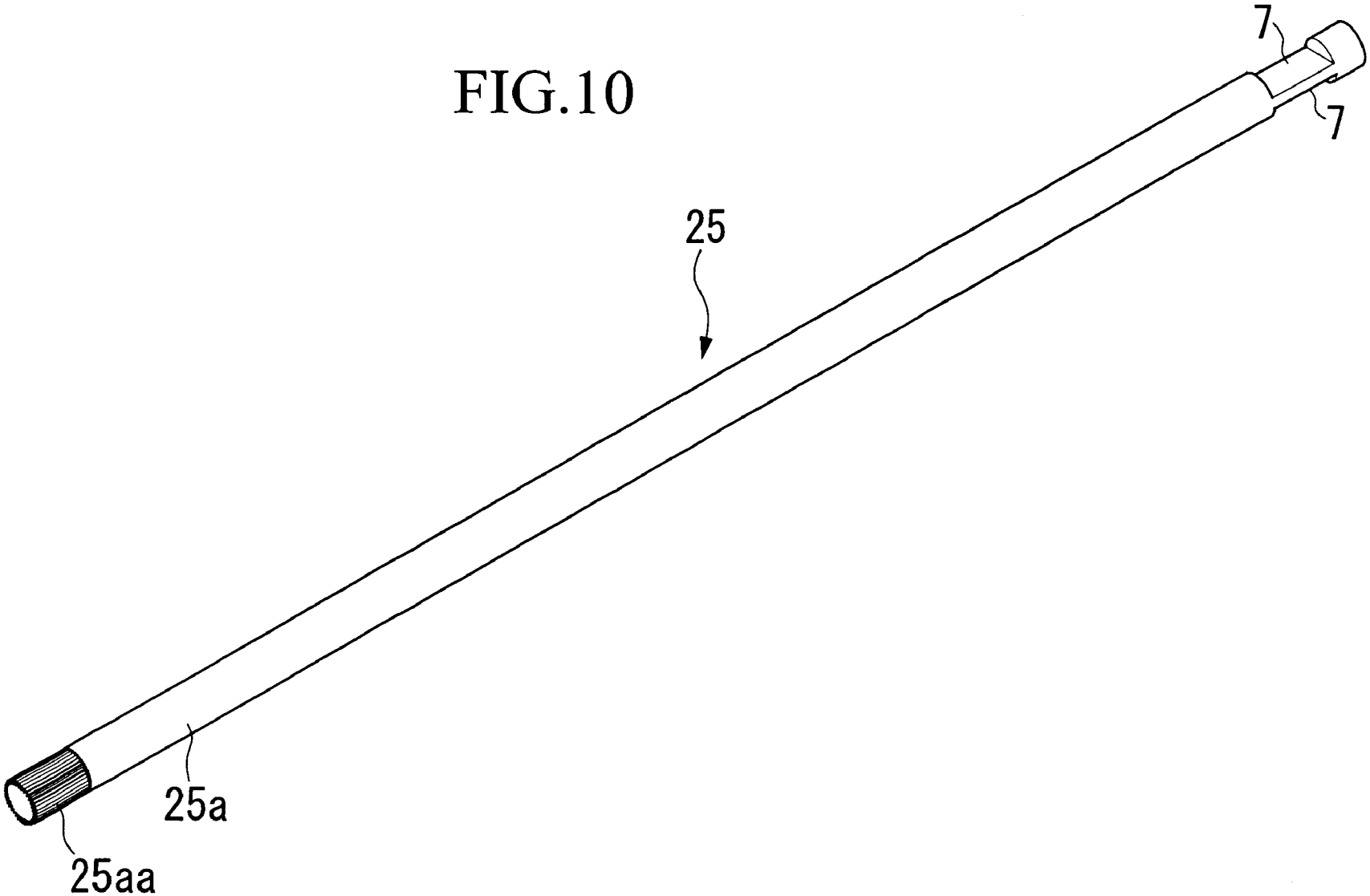
FIG. 10 is a perspective view of another example of the protruding rod member in the second embodiment.
Figure 11A:
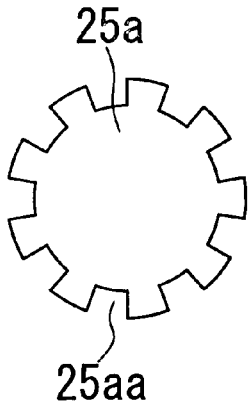
FIG. 11A is an illustration of an examples of the profile shape of the tip of the protrusion section.
Figure 11B:
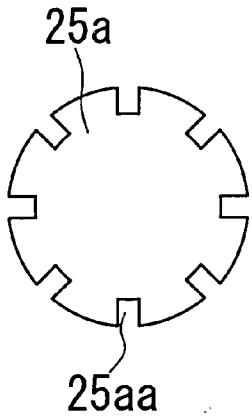
FIG. 11B is an illustration of an examples of the profile shape of the tip of the protrusion section.
Figure 11C:
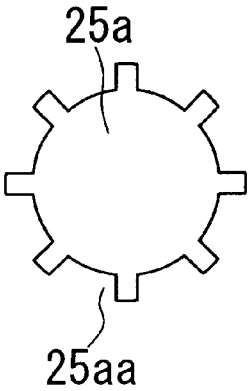
FIG. 11C is an illustration of an examples of the profile shape of the tip of the protrusion section.
Figure 11D:
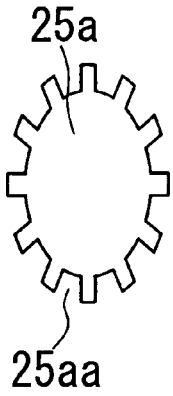
FIG. 11D is an illustration of an examples of the profile shape of the tip of the protrusion section.
Figure 11E:
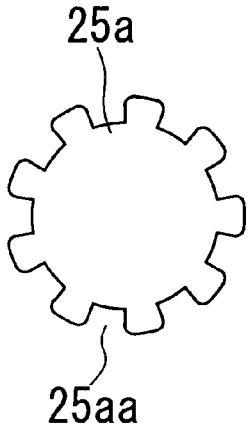
FIG. 11E is an illustration of an examples of the profile shape of the tip of the protrusion section.

Also, surface notches 25*aa* may be fabricated around the entire outer tip surface of the protruding rod members 25, as shown in FIG. 10, along the axial lines of the protrusion section 25*a*. Some specific examples of the surface notches 25*a* include three-sided notches shown in FIGS. 11A~11E. FIG. 11 A shows surface notches consisting of square shaped individual notches; the notches in FIG. 11B are similar but have wide tops and narrower valleys; conversely, the notches in FIG. 11C have narrow tops and wider valleys; the notches in FIG. 11D are fabricated on protruding rod member having an oval cross sectional shape; and the notches in FIG. 11E have rounded top corners.

Figure 8:
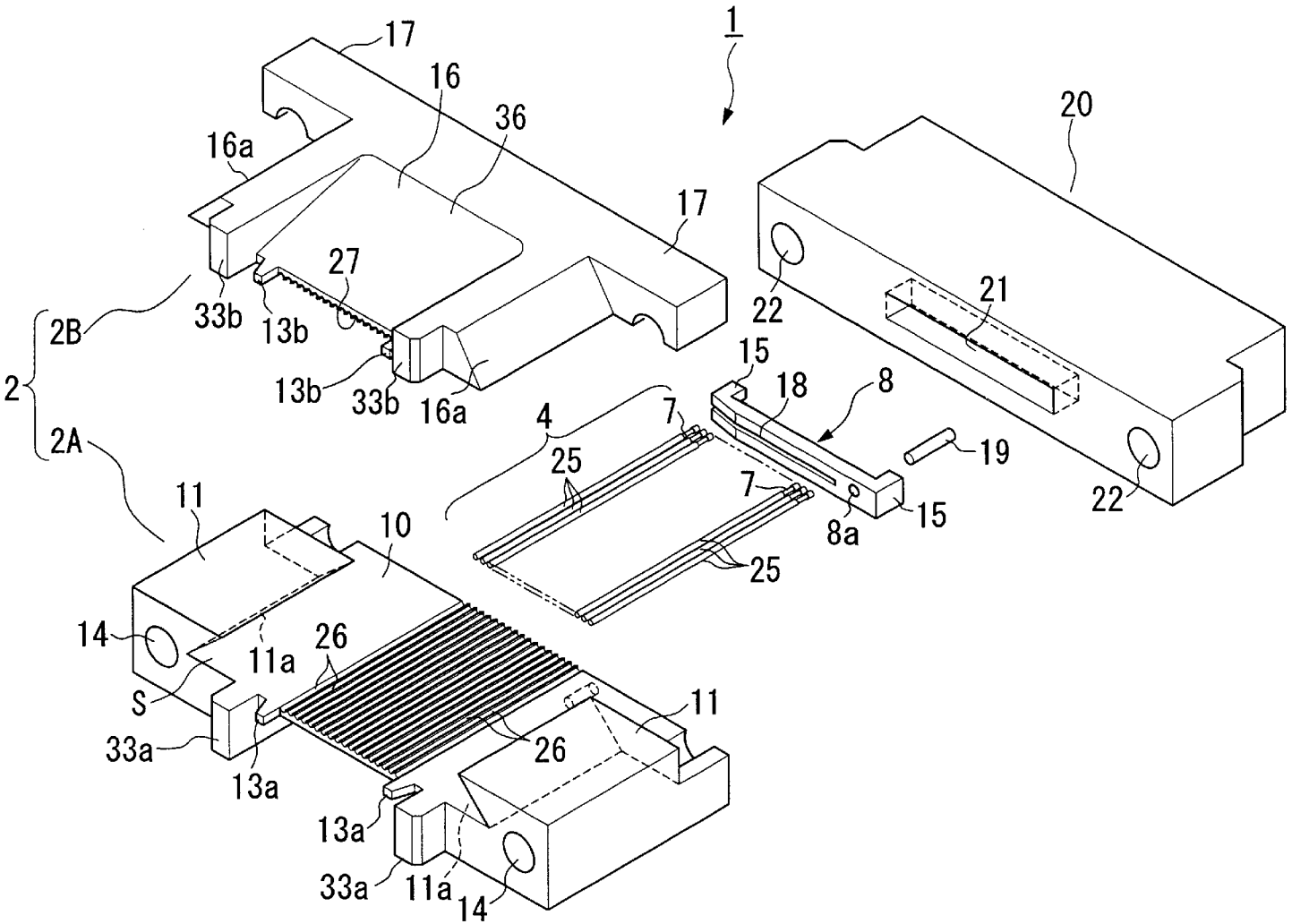
FIG. 8 is an exploded perspective view of a male extrusion die in the second embodiment.

As shown in FIG. 8, a plurality of parallel locating grooves 26 having a semi-circular cross section are fabricated in the center region of the plate section 10 of the base section 2A of the male die assembly 2 to fit the shape of the protruding rod members 25. Similar grooves 27 having a semi-circular cross section are fabricated on the bottom surface of the lid section 2B of the male die assembly 2 shown in FIG. 8.

Figure 12A:
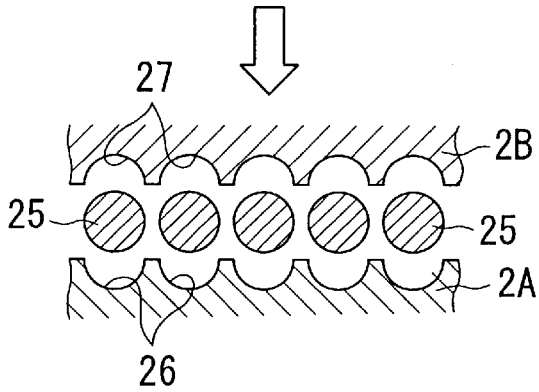
FIG. 12A is a cross sectional view which shows the another methods of fixation of the protruding rod member in the second embodiment.

That is, as shown in FIG. 12A, the protruding rod members 25 are placed between the semi-circular locating grooves 26, 27 that are spaced apart, respectively, on the opposing surfaces of the base section 2A and the lid section 2B of the male die assembly 2 are firmly fixed therein.

Figure 12B:
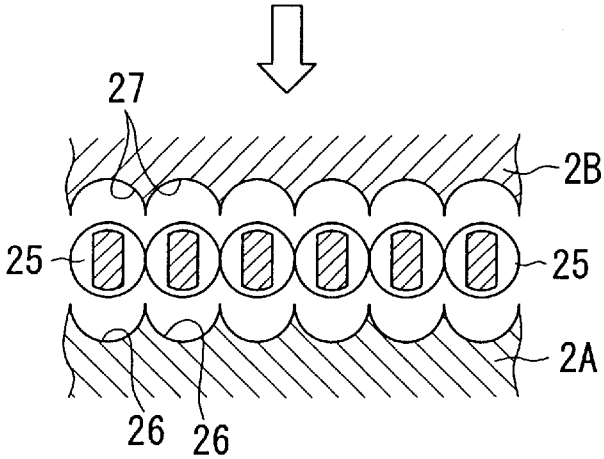
FIG. 12B is a cross sectional view which shows the another methods of fixation of the protruding rod member in the second embodiment.

Method of fixation of the protruding rod members 25 is not limited to the above method, and includes an arrangement of the locating grooves 26, 27 that are not spaced apart but are contiguous, as shown in FIG. 12B, between the opposing surfaces of the base section 2A and the lid section 2B. In this case, the protruding rod member 25 has a shape shown in FIG. 9C.

Figure 12C:
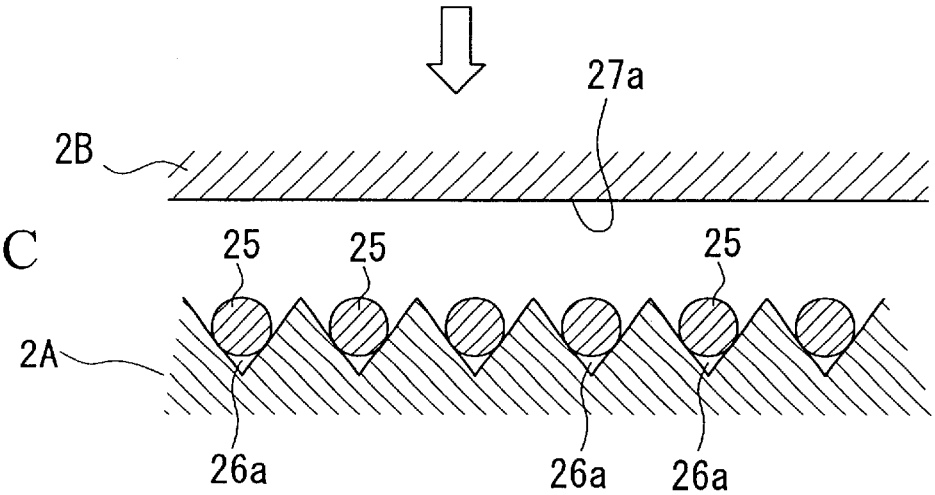
FIG. 12C is a cross sectional view which shows the another methods of fixation of the protruding rod member in the second embodiment.

Another arrangement of the grooves is shown in FIG. 12C, in which triangular shaped locating grooves 26*a* are fabricated on the base section 2A and a flat surface 27*a* is provided on the lid section 2B so that the protruding rod members 25 are clamped between the opposing surfaces of the lid section 2B and the base section 2A and are held in place by the parallel locating grooves 26*a* and the flat surface 27*a*.

In this embodiment also, the core 4 shown in FIG. 8 is comprised by individually prepared protruding rod members 25, and has a much simpler structure than the core 31 of a conventional design, shown by the 2-dot line in FIG. 17, so that the core 4 can be prepared by grinding instead of the electrical discharge machining. Because mechanical fabrication methods such as grinding do not produce the molten abnormal layer that is produced when the electrical discharge machining is used, or produce a phenomenon of chipping or micro-flaking so that the service life of the core 4, comprised the protruding rod members 25, can be improved significantly, as in the case of the core presented in Embodiment 1.

Embodiment 3

FIGS. 13~16 show further examples of the male die configuration in Embodiment 3.

In Embodiments 1, 2, the male die assembly 2 is split into two section in the center region, but in Embodiment 3, the male die assembly 28 is made in one piece.

Figure 13:
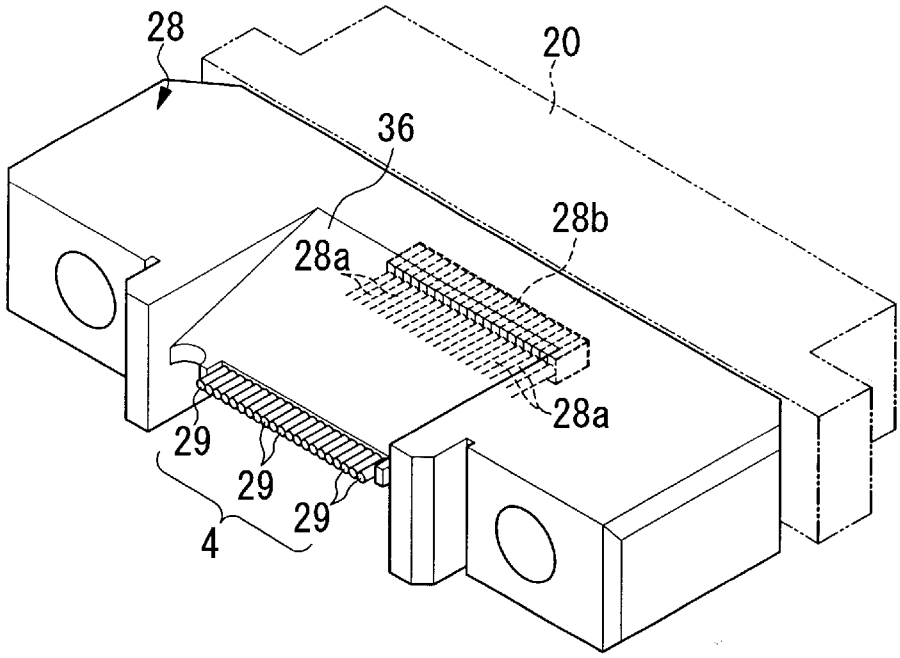
FIG. 13 is a perspective view of a male extrusion die in a third embodiment of the present invention.
Figure 14:
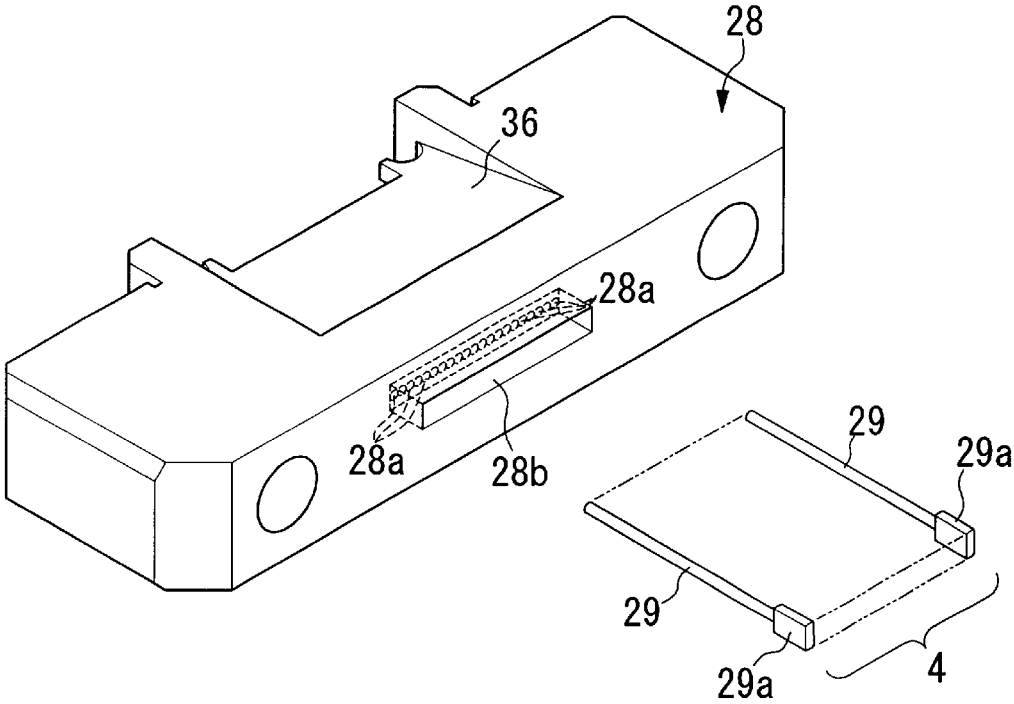
FIG. 14 is an exploded perspective view of a modification of the male extrusion die in the third embodiment.
Figure 15:
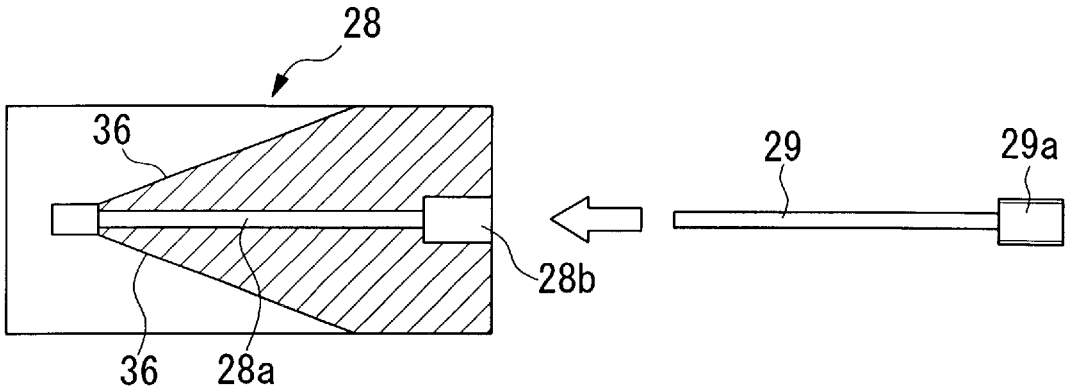
FIG. 15 is a cross sectional view of a male extrusion die in the third embodiment.

The basic structure of the male die assembly 28 shown in FIGS. 13, 14, is the same as the split male die assembly 2 comprised by coupled base section 2A and the lid section 2B.

A plurality of circular holes 28*a* separated at a given distance in the width direction are provided to extend along the metal flow direction from one end of the male die assembly 28 to the opposite end of the male die assembly 28 in the region of the male die assembly 28 located in the center region which forms flow-in sections 36. Openings 28*b* to communicate with the holes 28*a* are provided on the upstream side of the male die assembly 28 with respect to the metal flow direction.

Figure 16:
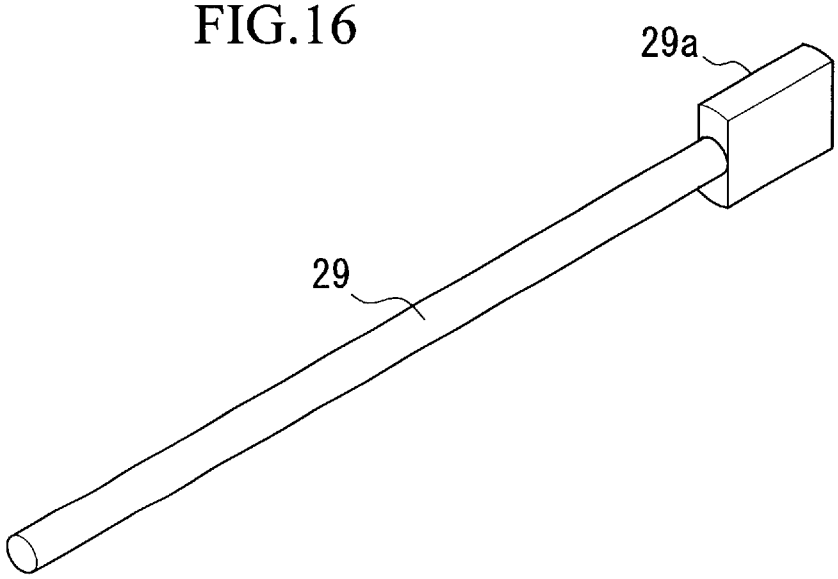
FIG. 16 is a perspective view of a protruding rod member in the third embodiment.

Protruding rod members 29, shown in FIG. 16, to comprise the core 4 are inserted into the holes 28*a* from the opening 28*b* so as to extend the tips out of the male die assembly 28, and is installed in the opening 28*b* by coupling a rectangular shaped large diameter base section 29*a* with the opening 28*b*. A cap member 20 is attached to the upstream side of the male die assembly 28 with respect to the metal flow direction. The cap member 20 is necessary for preventing the affixation of the high pressure toward the large diameter base sections 29*a* of the protruding rod members 29 and the opening 28*b*.

To fabricate a large number of holes 28*a* in the male die assembly 28, starting holes are first fabricated using fine diameter electrical discharge machining, and the hole size is increased by wire cutter to produce near circular holes. This method enables to produce a number of closely spaced holes 28*a* separated by a very thin wall in a near circular shape to be able to position the protruding rod members 29 appropriately.

In this embodiment also, the core 4 is comprised by a plurality of individually prepared protruding rod members 29, and because each protruding rod member 29 has a simple shape, grinding can be used to fabricate in place of the electrical discharge machining, and therefore, the service life of the core 4 comprised by the protruding rod members 29 can be improved significantly.

The above embodiments are provided for illustrative purposes only, and the design may be modified, as needed, within the interpretation of limits disclosed in the claims.

For example, in Embodiments 1 and 2, the common stopper 8 is engaged in the locking notch 7 of the base section 3*b* to lock the protruding rod members 5, 25 in place, but other methods may be used, such that the overall shape of the protruding rod members 5, 25 may be made in an L-shape by providing a transverse protrusion section on the end section of the protruding rod members 5, 25, so that the protruded end section can be engaged with the end surface of the male die assembly 2 to prevent the protruding rod members 5, 25 to shift in the axial direction.

The above embodiments are illustrated using an extrusion die comprised by a rectangular shaped plate as the male die and a cylindrical shaped column as the female die, but it is obvious that the present invention can be applied to a general purpose extrusion dies comprised by cylindrical male and female dies.

What is claimed is:

1. An extrusion die comprised by a male die having a plurality of protrusion sections separated at a given distance and a female die having a die cavity for inserting said protrusion sections, so that a die assembly prepared by linking coupling sections of said male die with coupling sections of said female die is installed in an extrusion press in such a way that a billet material is pushed through spaces formed between the die cavity and the protrusion sections to produce a multi-hole flat tube, wherein said male die is comprised by a male die body and a core member having said protrusion sections firmly locked in a central region of the male die body; wherein said core member is comprised by a plurality of individually fabricated pin-shaped protruding rod members, comprising said protrusion sections and associated base sections, to be locked-in firmly with the male die body, that extend upstream with respect to a material flow.

2. An extrusion die according to claim 1, wherein said protrusion section formed at downstream end on each of said protruding rod member serve as a shaping section to extrude the billet material into a given shape by contacting the billet material and said base section on an upstream end has a locking notch to prevent the protruding rod member to shift in an axial direction.

3. An extrusion die according to claim 1, wherein said protruding rod member is fabricated by grinding at least those locations that contact the material.

4. An extrusion die according to claim 2, wherein said protruding rod member is fabricated by grinding at least those locations that contact the material.

5. An extrusion die according to claim 1, wherein said protruding rod member is fabricated by polishing at least those locations that contact the material.

6. An extrusion die according to claim 2, wherein said protruding rod member is fabricated by polishing at least those locations that contact the material.

7. An extrusion die according to claim 1, wherein said protruding rod member is fabricated by first grinding at least those locations that contact the material, followed by polishing.

8. An extrusion die according to claim 2, wherein said protruding rod member is fabricated by first grinding at least those locations that contact the material, followed by polishing.

9. An extrusion die according to claim 1, wherein said protruding rod member is fabricated by first electrical discharge machining at least those locations that contact the material, followed by polishing.

10. An extrusion die according to one of claims 1 to 9, wherein said protruding rod member has a finely serrated section fabricated along the axial direction at least around external tip regions of the protruding rod member.

* * * * *